United States Patent [19]

Lin

[11] Patent Number: 4,788,529

[45] Date of Patent: Nov. 29, 1988

[54] MULTIFUNCTIONAL SAFETY GAS FLOW REGULATOR'S CONTROLLER

[75] Inventor: Jiann-Yi Lin, Taipei Hsien, Taiwan

[73] Assignee: Pao Yin Co., Ltd., Taiwan

[21] Appl. No.: 43,398

[22] Filed: Apr. 28, 1987

[51] Int. Cl.[4] ..... G08B 19/00; F23N 5/24

[52] U.S. Cl. ..... 340/521; 340/500; 340/501; 340/577; 340/635; 340/632; 126/39 R; 431/15; 431/16

[58] Field of Search ..... 340/521, 500, 501, 577, 340/632-634, 635, 636, 653, 650, 649; 126/388, 19.5, 1 R, 39 R, 39 E, 42; 236/21 R, 94, DIG. 2, DIG. 3; 110/185, 193; 431/15, 16, 13, 42

[56] References Cited

U.S. PATENT DOCUMENTS

| | | | |
|---|---|---|---|
| 3,683,372 | 8/1972 | Horn | 340/521 |
| 3,967,281 | 6/1976 | Paseford | 340/521 |
| 4,295,129 | 10/1981 | Cade | 340/501 |
| 4,710,125 | 12/1987 | Nakamura et al. | 340/579 |

*Primary Examiner*—Donnie L. Crosland
*Attorney, Agent, or Firm*—Armstrong, Nikaido, Marmelstein & Kubovcik

[57] ABSTRACT

A multifunctional safety gas flow regulator controller, mainly composed of an electronic circuit, automatically starts an alarm and controls components that close the gas supply when the flame is accidentally extinguished or when the battery has an inadequate power supply. The controller is characterized by its multifunctional safety controller for proper disposal of gas tools.

11 Claims, 4 Drawing Sheets

MULTIFUNCTIONAL SAFETY GAS FLOW REGULATOR'S CONTROLLER

SUMMARY OF THE INVENTION

The present invention relates to a multifunctional safety controller for application in a gas oven, gas heater and gas Bar B.Q. grill, mainly composed of an electronic circuit which automatically starts an alarm and closes the gas supply by means of an electromagnetic valve when the flame is accidentally extinguished, or starts a pre-alarm for replacement of battery when its power supply will be inadequate soon before use or during use in order to prevent an accident from occurring when there is no power supply to close the gas supply, or to close the power supply for the main flame when the induction electrode is accidentally grounded.

DETAILED DESCRIPTION OF THE PREFERRED EMBODIMENT

Figure 1:
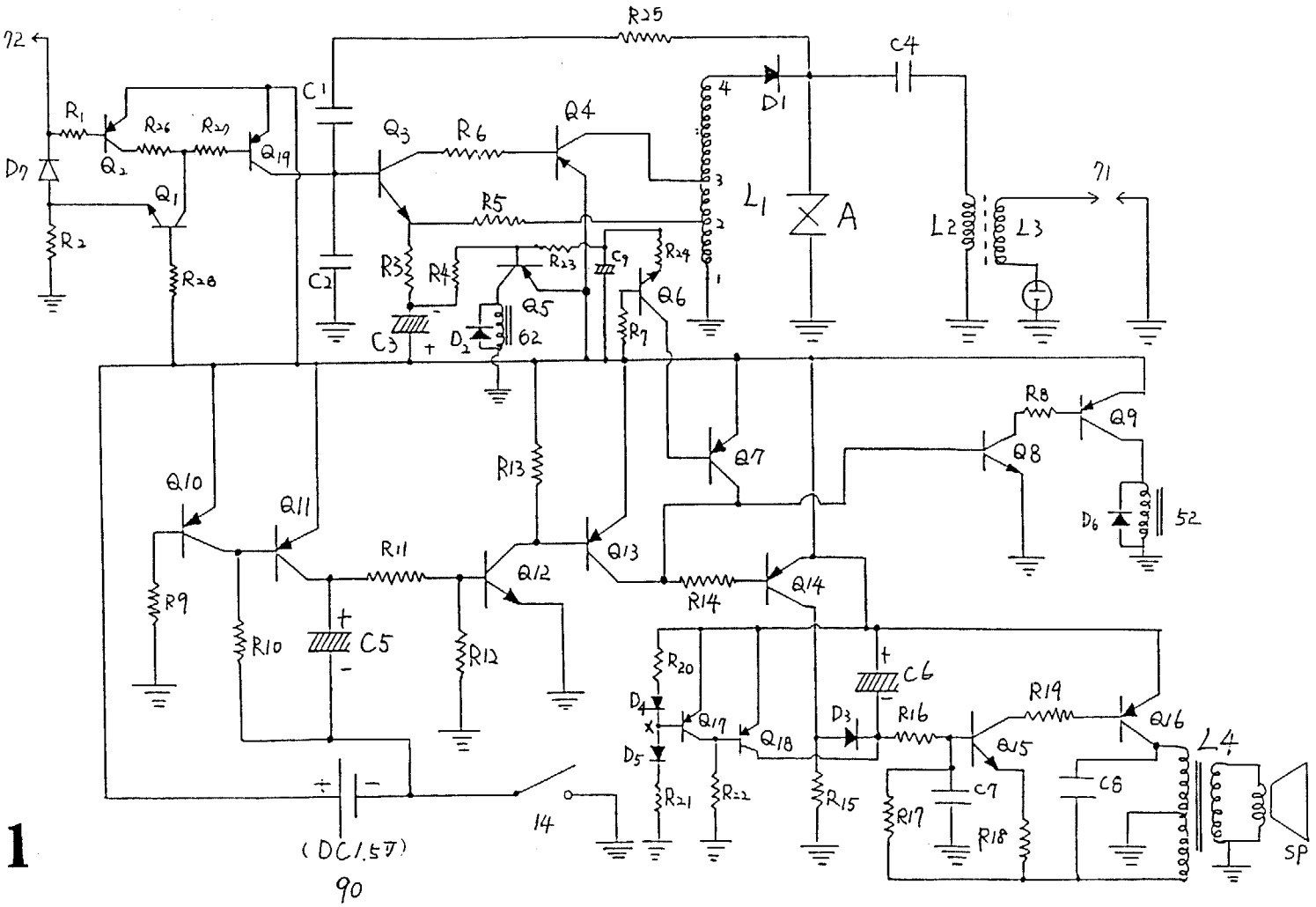
FIG. 1 is a view showing a circuit in accordance with the present invention.
Figure 2:
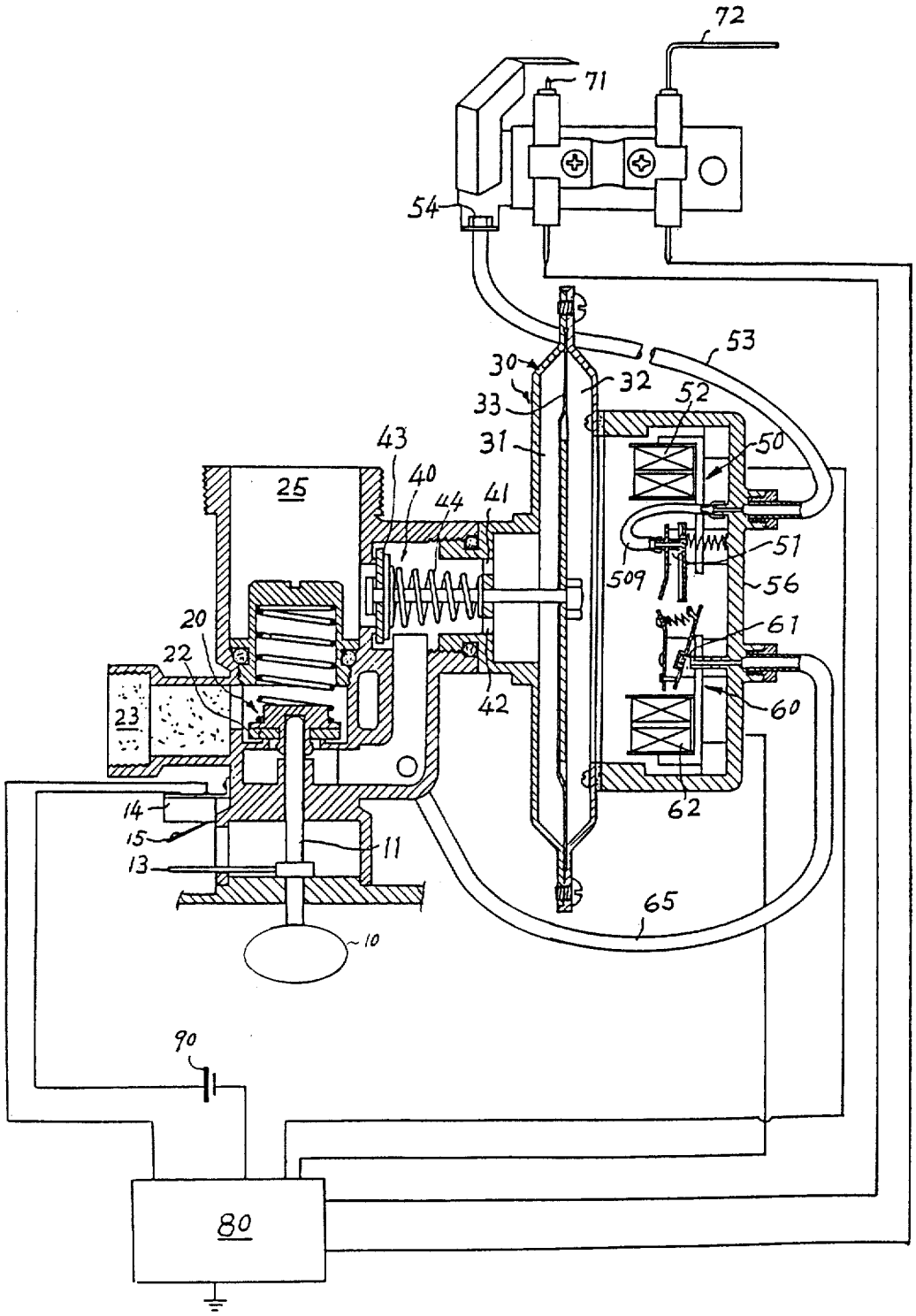
FIG. 2 is a sectional view of a gas cooker utilized in accordance with the present invention.
Figure 3:
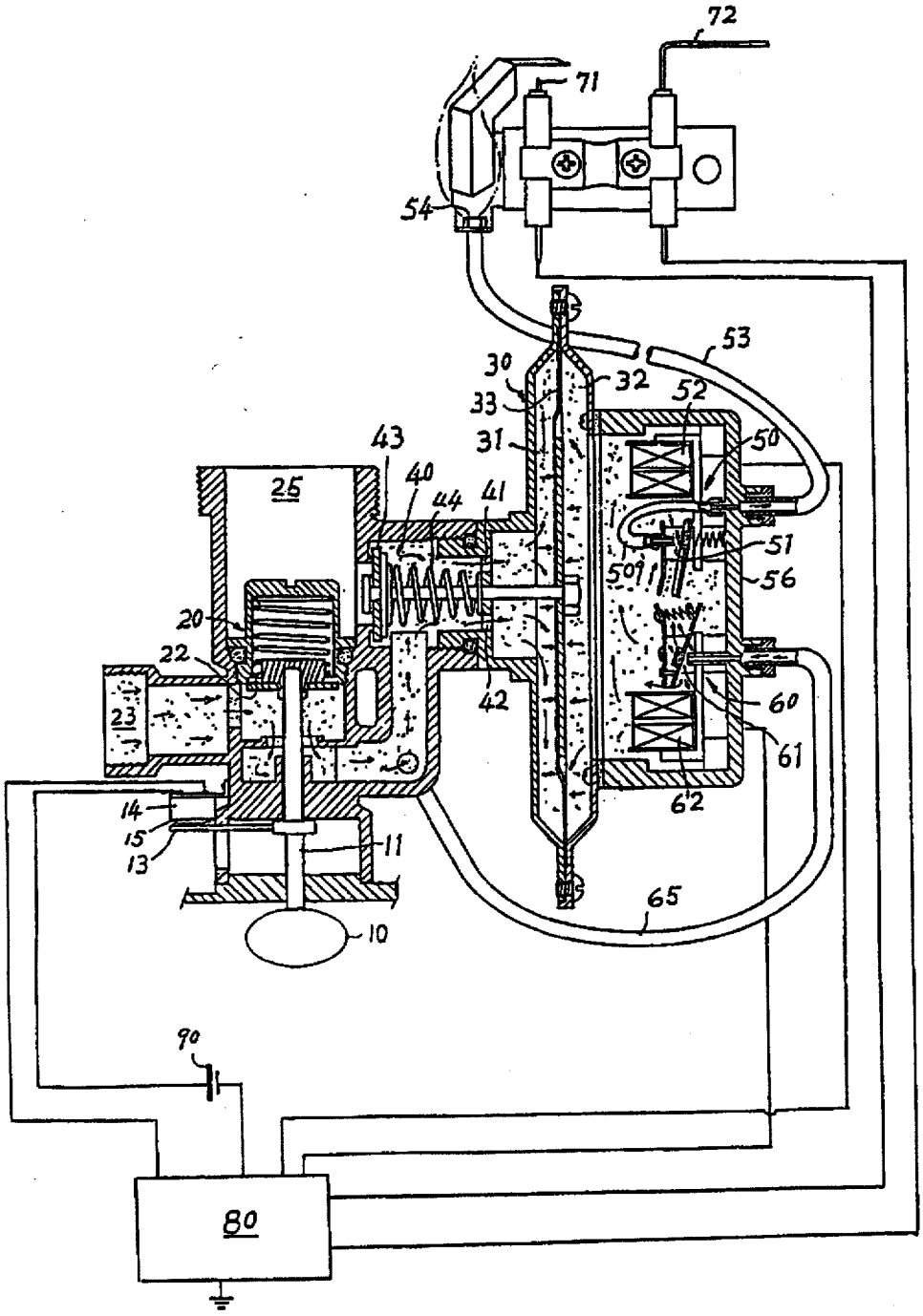
FIG. 3 is a first schematic view illustrating the working of the gas cooker shown in FIG. 2.

Referring to FIGS. 1 to 4, it can be seen that when switch 14 of electronic circuit 80 is ON, on the one hand, C5 is discharged, and solenoid 52 of always-closed, electromagnetic valve 50 is magnetically excited to cause the flowing out of gas through the nozzle 54 of the mother flame. On the other hand, bias is produced by R28, Q1 is conducted, bias is produced by R27, Q19 is conducted, which cause the formation of a vibrational loop by Q3, Q4, L1, C2 and Q5, R6. An electrical voltage is formed at the 4th plug of L1 which is rectified by D1 and then transferred to C4 and L2 to form a charging circuit. When the electrical voltage has reached a certain value, bilateral diode A will be grounded to make C4 discharge and a large current is produced by L2 to form a high electrical voltage at L2. As a result, electronic ignition is made by ignition electrode 71 to burn the gas flowing out from mother nozzle 54 to become the mother flame. During the ignition process, electromagnetic valve 62 has no electric current passing through and is always kept open to make differential membrane 30 close the gas supply for the main flame. When the mother flame is formed, induction electrode 72 induces a current to maintain magnetic excitement of solenoid 52 after C5 is discharged. This current flows from R1 to pole B of Q2. As a result, Q2 is conducted, Q1 is short circuited, and Q19 has no bias. Q3 and Q4 are opened because of no IB, D1 gives no electrical voltage for charging, L3 gives no more high electrical voltage and 71 stops ignition. At this time, electromagnetic solenoid 62 is charged to make electromagnetic valve 60 close the gas supply for the mother flame. Then, the gas supply for the main flame flows out and accepts the ignition of the mother flame to become the main flame. Referring back to FIG. 1, Q10, Q12, R9, R10, C5 form an automatic charging loop. When switch 14 is OFF, negative voltage is transferred from R10 to pole B of Q11 and positive voltage is conducted from pole E of Q11 to pole C to charge C5. When switch 14 is ON, negative voltage is grounded and flows from R9 to pole B of Q10 which connects E and C of Q10 and causes a short circuit of IB of Q11. As a result, Q11 cannot be conducted and charged. At this time, Q12, Q13 are conducted through discharge from C5 and R11. Positive voltage from pole C of Q13 flows to Q8 and conducts through Q9 to cause magnetic excitement of solenoid 52 of electromagnetic valve 50 and open valve 51 which control gas supply for the mother flame (as shown in FIG. 3). If all electricity charged in C5 is totally discharged, and the mother flame has not been ignited, then induction electrode 72 has no induction current, Q12, Q13 cannot be conducted because of no bias, Q8 is short circuited, solenoid 52 of electromagnetic valve 50 is cut off, valve 51 returns to position which close the gas supply to achieve the objective of automatically closing the gas supply for the mother flame. At this time, Q14 is conducted, positive voltage passes from pole C of Q14, D3 to Q15, and Q15, Q16 and L4 form a vibrational loop which makes horn SP at the edge of output transformer sound to inform us to turn off the switch axle 10 for gas supply so as the switch 14 is OFF. The horn stops sounding and then accidental factors are eliminated follow by operation of ignition again. Q6, Q7 are used to control Q8 and IB of Q14. If the signal of ignition of the mother flame is detected by induction electrode 71, Q19 is in open circuit manner, 71 stops ignition, Q3, Q4 and L1 cannot produce vibration, positive electromagnetic force of pole C of Q4 disappears, first plug of L1 is grounded, negative voltage is conducted through 3rd plug to R6 which makes Q6, Q7 connect, positive voltage is given by pole C of Q7 to make IB of Q14 short circuit and Q15, Q16 in open circuit manner. In this case, the gas cooker is in a normal operation mode and the horn SP will not give an alarm. If electrical voltage of battery 90 is higher than the forward voltage of diode D4, D5 (the lower limit of that forward voltage is used as the lower limit for the working voltage of electromagnetic valve), D5 is conducted to produce bias for Q17 (there is electrical voltage at X), which makes Q17 function, R22 short circuit, Q18 not function and its backward circuit (including horn, Q15, Q16, D5) not function. In other words, at this condition, the electrical voltage of battery is normal and requires no replacement. However, when electrical voltage of battery 90 is lower than the forward voltage of diode D4, D5 (i.e., a low electrical voltage which makes electromagnetic valve unable to function), D5 is not conducted, no electrical voltage is present at X, no bias at Q17, Q18 functions and sends positive electricity to Q15 to produce vibration in the vibrational circuit formed by Q15, Q16, R17, R18, R19, C8 and L4. The horn is forced to sound to inform us that the electrical voltage of battery is too low to use and should be replaced. When switch 14 is OFF, the horn will stop sounding. If induction electrode 72 is accidentally grounded, then during the process of ignition, since 72 is grounded, D7 is conducted, R2 is short circuited, the circuit behind Q1 to R27 still functions which makes electromagnetic solenoid 52, 62 not function. As a result, gas supply for main flame does not flow out to maintain safety. Once the factor of grounding is eliminated, normal operation is retained.

Figure 4:
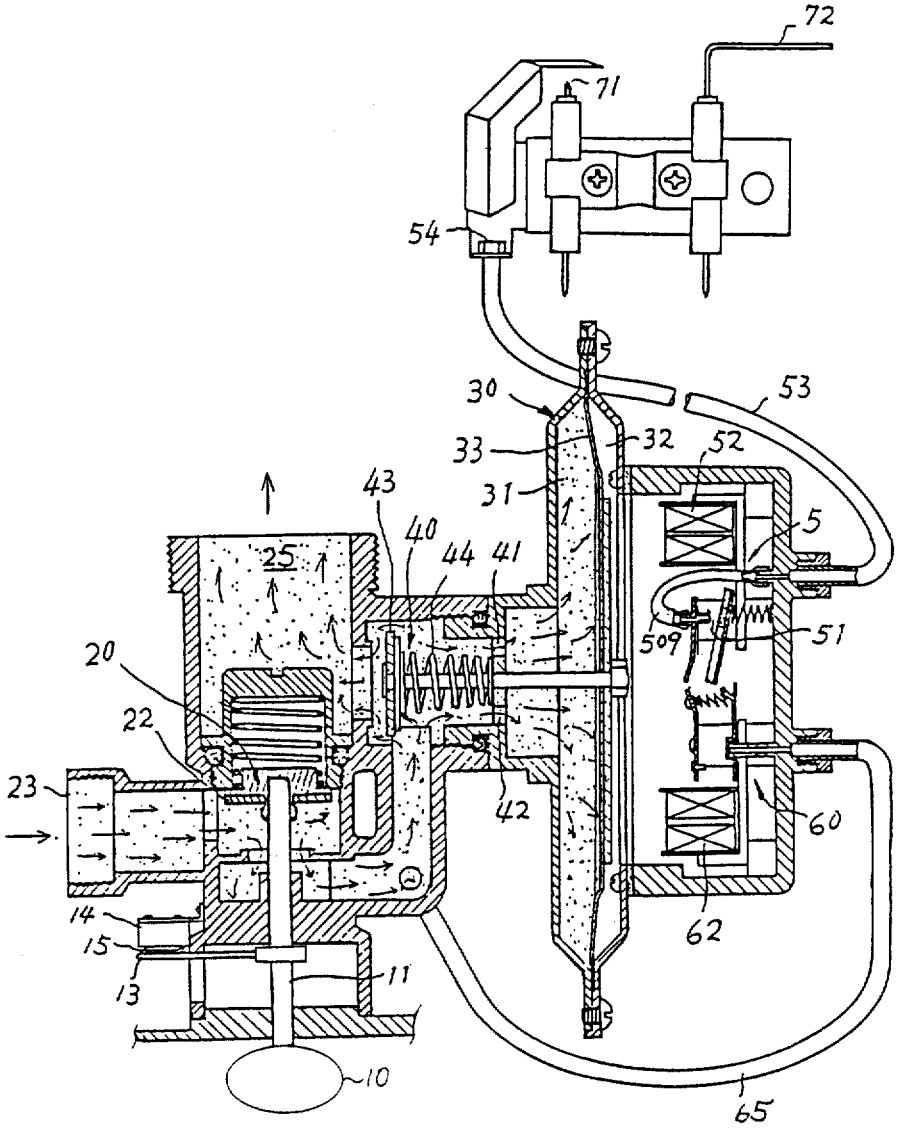
FIG. 4 is a second schematic view illustrating the working of the gas cooker shown in FIG. 2.

The mechanical operations of an accustomed gas cooker for the electonic circuit of the present invention are shown in FIG. 2 to 4 and explained as follows. Basically, the gas cooker includes a gas switch axle 10, a main gas controlling valve 20 which can be opened by a guide rod 11 installed on the gas switch axle 10; a differential membrane 30 having a first gas chamber 31 and a second gas chamber 32; a main flame gas controlling valve 40 which can be opened by means of the relationship of pressure difference of differential membrane 30; an always-closed electromagnetic valve 50 and an always-opened electromagnetic valve 60 installed in the second gas chamber of membrane 30; a high voltage electronic ignition circuit 80, an ignition electrode 71 and induction electrode 72 and a working power source 90, etc. When rotational axle 10 pushes guide rod 11 upward, as shown in FIG. 3, movable arm 13 attached on guide rod 11 contacts with operational arm 15 of switch 14, and power supply 90 is sent to high voltage electronic ignition system 80 and electromagnetic solenoid 52 of always-closed electromagnetic valve 50 to cause magnetic excitement and open the valve gate 51 of electromagnetic valve 50. As a result of the upward movement of guide rod 11, valve gate 22 of main controlling valve 20 is opened, and gas will flow from inlet pipe 23 through valve gate 22 to side pipe 24 and further to the valve chamber of main flame gas controlling valve 40 and pass through holes 41, 42 to the first gas chamber 31 of differential membrane 30. In addition, high voltage ignition starts. However, electromagnetic solenoid 62 of always-opened electromagnetic valve 60 has not magnetically excited yet which permits mother flame 512 to flow from conduit 65, valve gate 61 of always-opened electromagnetic valve 60, interior of box 56, valve door 51 of always-closed electromagnetic valve 50, conduit 509, 53 to mother nozzle 54, then ignition by ignition electrode 71 to light up mother flame as shown in Fig. 3. At this time, since the first gas chamber 31 and the second gas chamber 32 at the two sides of differential membrane 30 are both filled with gas, it is located at the equilibrium position, i.e. both membrane 33 and the main flame gas controlling valve 40 remain at their original position as shown in the figures. As a result, gas entering the interior of pipe 23 cannot enter the main flame gas pipe 25.

When mother flame is ignited, inductive electromotive force produced by induction electrode 72 will stop the operation of high voltage ignition, electromagnetic solenoid 62 of always-opened electromagnetic valve 60 is magnetically excited to close its valve gate 61 and close the gas supply for the mother flame. Residual gas remained in the second gas chamber is burned slowly by the mother nozzle. Since the second gas chamber and the box have an adequate space to occupy residual gas for continual burning of mother flame for a certain period after the ignition of main flame is achieved. At this time, since the valve gate 61 of always-opened electromagnetic valve 60 is closed, there is no circulation of gas in the second gas chamber 32 of differential membrane 30 and excess gas is completely burned by the mother nozzle. As a result, the second gas chamber loses its pressure and a pressure difference is set up between the first gas chamber and the second gas chamber since gas circulation is continued and filled rapidly the first gas chamber. Since the gas pressure is exerted on a large area of membrane 33, the effect of pressure difference is able to overcome elastic force of compression spring 44 for normal manner locking of the valve gate 43 of main flame gas controlling valve 40 and produce a displacement toward the second gas chamber of differential membrane 33 and main flame gas controlling valve 40 together. Valve gate 43 is opened to make gas inside gas pipe 23 flow through valve gate 43 to main flame gas pipe 25. Then, from the main flame gas pipe 25, the gas is directly conducted to the main nozzle (not shown in figures) and ignited by mother flame to complete the safety ignition of the main flame.

The present invention has an advantage that its circuit structure is simple and can be used with any general gas tools to assure the safety of users.

I claim:

1. A high voltage electronic ignition circuit of a controller for a multifunctional safety gas flow regulator having a main flame and a mother flame, said high voltage electronic ignition circuit comprising:

an induction electrode for detecting ignition of the mother flame and for stopping ignition after the mother flame ignites;

first biasing means, connected to said induction electrode, for biasing said induction electrode;

a first vibration loop means connected to said first biasing means, for producing an electric voltage;

a rectifying means connected to said first vibration loop means, for rectifying the voltage from said first vibration loop;

a charging circuit means, connected to said rectifying means, for producing a charging voltage;

an ignition electrode, connected to said charging circuit means and ground, for ignition of the mother flame by said charging voltage;

an automatic charging loop means, connected to said first biasing means, for controlling the gas supply for the mother flame and for ignition of the mother flame;

a power source means connected to said automatic charging loop means;

a switch means connected to said power source means, said automatic charging loop means and ground, for turning the high voltage electronic ignition circuit on and off;

a control means, connected to said automatic charging loop means and said first vibration loop means, for controlling gas supply of the mother flame and for controlling sounding an alarm;

a solenoid means connected to said control means and said automatic charging loop means, for controlling the gas to flow to the mother flame;

second biasing means connected to said control means and to ground for producing a biasing signal;

second vibration loop means connected to said second biasing means and said control means for producing an alarm generating signal and horn means, connected to said second vibration loop means, for sounding the alarm, wherein the alarm is automatically started when either one of the main flame or the mother flame are extinguished and when a power shortage occurs and wherein said ignition circuit functions as a multifunctional safety controller which controls the gas supply to the main flame or mother flame when the induction electrode is grounded.

2. An electronic circuit as set forth in claim 1, wherein when the switch means is ON, the automatic charging loop means discharges, and the solenoid means of a first electromagnetic valve is magnetically excited to cause the flowing out of gas through a nozzle of the mother flame, bias is produced by the first biasing means which produce the voltage of the first vibration loop to be rectified by the rectifying means and then transferred to the charging circuit means, when the electrical voltage has reached a certain valve, the charging circuit means is discharged and a large current is produced to form a high electrical voltage, and as a result, electronic ignition is made by the ignition electrode to burn the gas flowing out from the mother nozzle to become the mother flame.

3. An electronic circuit as set forth in claim 2, wherein during the ignition process of the mother flame, a solenoid of a second electromagnetic valve has no electric current passing through which makes a differential membrane close the gas supply for the main flame.

4. An electronic circuit as set forth in claim 2, wherein when the mother flame is formed, the induction electrode induces a current to maintain magnetic excitement of the solenoid means after the automatic charging loop means discharges to the biasing means and as a result, no bias is applied to the first vibration loop so that no electrical voltage is supplied for charging the charging circuit means so that the ignition electrode stops ignition.

5. An electronic circuit as set forth in claim 4, wherein when ignition electrode stops ignition, the solenoid is charged to make the differential membrane open the gas supply for the main flame to accept the ignition of the mother flame to become the main flame.

6. An electronic circuit as set forth in claim 2 wherein if the automatic charging loop is discharged and the mother flame has not been ignited yet, then the induction electrode has no induction current, the solenoid means of the first electromagnetic valve is cut off to automatic close the gas supply for the mother flame.

7. An electronic circuit as set forth in claim 6, wherein when the mother flame is closed, the second vibration loop makes the horn means sound to indicate to turn off a switch axle for gas supply so that the switch means is OFF, the horn means then stops sounding.

8. An electronic circuit as set forth in claim 4, wherein when ignition electrode stops ignition, the first vibration circuit means produces negative voltage which makes the control means conduct positive voltage to the second vibration loop to inhibit the horn means from sounding indicating gas flow regulator is in normal operation and the horn means will not give the alarm.

9. An electronic circuit as set forth in claim 1 wherein if electrical voltage of the power source means is higher than a forward voltage of the second biasing means, the second biasing means prevents the horn means from sounding indicating the electrical voltage of battery is normal and requires no replacement.

10. An electronic circuit as set forth in claim 9, wherein if electrical voltage of the power source means is lower than the forward voltage of the second biasing means, the second biasing means sends positive electricity to the second vibration loop means so that the horn means is forced to sound indicating that the electrical voltage of the power source means is low and should be replaced.

11. An electronic circuit as set forth in claim 1, wherein if induction electrode is grounded, then during the process of ignition, since the induction electrode is grounded, the solenoid means functions to close the power source means for the main flame to assure safety.

* * * * *